US008323422B2

(12) United States Patent
Ohwaki et al.

(10) Patent No.: US 8,323,422 B2
(45) Date of Patent: Dec. 4, 2012

(54) PRODUCTION PROCESS OF DUST CORE AND DUST CORE OBTAINED THEREBY

(75) Inventors: Takeshi Ohwaki, Kobe (JP); Hiroyuki Mitani, Kobe (JP); Hirofumi Hojo, Takasago (JP); Tomotsuna Kamijo, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 13/302,103

(22) Filed: Nov. 22, 2011

(65) Prior Publication Data

US 2012/0154083 A1 Jun. 21, 2012

(30) Foreign Application Priority Data

Dec. 20, 2010 (JP) ..... 2010-283602

(51) Int. Cl.
*H01F 1/24* (2006.01)

(52) U.S. Cl. ..... 148/104; 148/306; 148/122

(58) Field of Classification Search ..... None
See application file for complete search history.

(56) References Cited

U.S. PATENT DOCUMENTS

| | | | | |
|---|---|---|---|---|
| 6,485,579 | B1 * | 11/2002 | Nillius et al. | 148/104 |
| 6,573,225 | B1 | 6/2003 | Vidarsson et al. | |
| 2008/0230737 | A1 | 9/2008 | Ishihara et al. | |
| 2010/0051851 | A1 * | 3/2010 | Mitani et al. | 252/62.54 |
| 2010/0188179 | A1 * | 7/2010 | Mitani et al. | 335/297 |
| 2010/0212455 | A1 * | 8/2010 | Ohwaki et al. | 75/246 |
| 2011/0068506 | A1 * | 3/2011 | Kusawake et al. | 264/319 |

FOREIGN PATENT DOCUMENTS

| | | |
|---|---|---|
| EP | 1 973 128 A1 | 9/2008 |
| JP | 2710152 | 10/1997 |
| JP | 2006-310873 | 11/2006 |
| JP | 4044591 | 11/2007 |
| JP | 2009-246256 | 10/2009 |
| WO | WO 01/19554 A1 | 3/2001 |

OTHER PUBLICATIONS

Machine Translation of JP 2006-310873, Nov. 9, 2012.*
U.S. Appl. No. 13/435,757, filed Mar. 30, 2012, Ohwaki, et al.
Extended Search Report issued Feb. 8, 2012 in Europe Application No. 11009655.9.

* cited by examiner

*Primary Examiner* — John Sheehan
(74) *Attorney, Agent, or Firm* — Oblon, Spivak, McClelland, Maier & Neustadt, L.L.P.

(57) ABSTRACT

Provided is a dust core excellent in flux density, iron loss, and mechanical strength.

A production process of a dust core according to the invention includes a step of compacting a mixture obtained by mixing an iron-based soft magnetic powder for powder compact having a phosphate conversion coating film on the surface of an iron-based soft magnetic powder with a lubricant to obtain a powder compact, a heat treatment step of heating the resulting powder compact at 550° C. or more but not more than 650° C. in an inert atmosphere, and a heat treatment step of heating the heat-treated powder compact at 420° C. or more but not more than 530° C. in an oxidizing atmosphere.

5 Claims, No Drawings

PRODUCTION PROCESS OF DUST CORE AND DUST CORE OBTAINED THEREBY

BACKGROUND OF THE INVENTION

The present invention relates to a production process of a dust core, and a dust core obtained using the production process.

For dust cores for electromagnetic parts, it is necessary and important to have a good handling property during their production step and have a mechanical strength high enough not to cause breakage during winding for making a coil. In consideration of such points, a technology of covering iron powders with an electrical insulating material is known in the field of dust cores. When iron powders are covered with an electrical insulating material, they are bonded to each other via the electrical insulating material so that a dust core available by using them can have an improved mechanical strength.

There has previously been disclosed a technology making use of a silicone resin having high heat resistance or a glassy compound available from phosphoric acid or the like as a material for preparing such an electrical insulating material (Japanese Patent No. 2710152).

The present applicants succeeded in providing a dust core having a high flux density, low iron loss, and high mechanical strength by forming, on the surface of an iron-based soft magnetic powder, a phosphate conversion coating film containing a specific element and a silicone resin film in this order and have already obtained a patent for it (Japanese Patent No. 4044591).

However, the demand for a dust core having a high performance has been rising recently compared with the application time of Japanese Patent No. 4044591. There is therefore an ever increasing demand for a dust core having a high flux density, low iron loss, and high mechanical strength.

SUMMARY OF THE INVENTION

An object of the invention is to provide a dust core more excellent in the properties such as flux density, iron loss, and mechanical strength.

With a view to achieving the above-described object, the present inventors have proceeded with an extensive investigation. As a result, it has been found that although a dust core having a reduced hysteresis loss is produced in Japanese Patent No. 4044591 by molding an iron-based soft magnetic powder for dust core obtained by forming, on the surface of an iron-based soft magnetic powder, a phosphate conversion coating film containing a specific element and a silicone resin film in order of mention, and then heat treating the powder at from 400° C. to 500° C. in an inert atmosphere, the heat treatment is achieved in two stages different in heating temperature zone and heat treatment atmosphere, leading to the completion of the invention.

The production process of a dust core according to the invention capable of satisfying the above-described object is characterized by that it has a compaction step, that is, a step of mixing a lubricant with an iron-based soft magnetic powder for powder compact having a phosphate conversion coating film on the surface of an iron-based soft magnetic powder and subjecting the resulting mixture to compaction to form a powder compact; a heat treatment step 1, that is, a step of heating the resulting powder compact at 550° C. or more but not more than 650° C. in an inert atmosphere, and a heat treatment step 2, that is, a step of heating the heat-treated powder compact at 420° C. or more but not more than 530° C. in an oxidizing atmosphere.

In the invention, it is preferred that the iron-based soft magnetic powder for powder compact has a silicon resin film on the phosphate conversion coating film, the inert atmosphere is a nitrogen atmosphere, the oxidizing atmosphere is an air atmosphere, and the lubricant is a polyhydroxycarboxylic acid amide.

The invention also embraces a dust core obtained by the above-described production process.

The production process of the invention makes it possible to provide a dust core having a high flux density, low iron loss, and high mechanical strength.

DETAILED DESCRIPTION OF THE INVENTION

The production process according to the invention is characterized by that it has a step of mixing a lubricant with an iron-based soft magnetic powder for powder compact (which may hereinafter be called "iron powder for powder compact", simply) having a phosphate conversion coating film on the surface of an iron-based soft magnetic powder and subjecting the resulting mixture to compaction to form a powder compact; a heat treatment step 1 of heating the resulting powder compact at 550° C. or more but not more than 650° C. in an inert atmosphere, and a heat treatment step 2 of heating the heat-treated powder compact at 420° C. or more but not more than 530° C. in an oxidizing atmosphere. In the heat treatment step 1, removal of the lubricant and relief from strain are performed and in the heat treatment step 2 subsequent thereto, the surface of the iron-based soft magnetic powder is oxidized. As a result, the phosphate conversion coating film forms a firm bond with the surface of the iron-based soft magnetic powder, which is presumed to improve the bonding force between the iron-based soft magnetic powders. As a result, the dust core thus obtained has an improved mechanical strength. The invention will next be described in detail.

[Iron-Based Soft Magnetic Powder]

The iron-based soft magnetic powder used in the invention is an iron-based powder of a ferromagnetic material. Specific examples include pure iron powder, iron-based alloy powders (Fe—Al alloy, Fe—Si alloy, Sendust, permalloy, and the like), and iron-based amorphous powders. These iron-based soft magnetic powders can be prepared, for example, by atomizing a molten iron (or a molten iron alloy) into the corresponding fine powders, reducing the fine powders, and the pulverizing them. Such a preparation process yields iron-based soft magnetic powders having a particle size (median diameter) of from about 20 μm to 250 μm, that is, the diameter at which the cumulative particle size distribution reaches 50% in the particle size distribution evaluated by a sieving method, can be obtained and the particle size (median diameter) of the iron-based soft magnetic powder used in the invention is preferably from about 50 to 150 μm.

[Phosphate Conversion Coating Film]

The iron powder for powder compact to be used in the invention has a phosphate conversion coating film. This can provide the iron powder for powder compact with electrically insulating properties.

The composition of the phosphate conversion coating film is not particularly limited insofar as it is a glassy film formed using a P-containing compound. It is preferably a glassy film formed using a compound containing, in addition to P, Co, Na, and S or a compound containing, in addition to P, Cs and/or Al. These elements prevent, during the heat treatment step 2, oxygen from forming a semiconductor with Fe to reduce the specific resistance.

When the phosphate conversion coating film is a glassy film formed using a compound containing, in addition to P, the above-described Co and the like, the contents of P, Co, Na, and S in 100 mass % of the iron powder for powder compact are from 0.005 mass % to 1 mass %, from 0.005 mass % to 0.1 mass %, from 0.002 mass % to 0.6 mass %, and from 0.001 mass % to 0.2 mass %, respectively. On the other hand, the contents of Cs and Al are preferably from 0.002 mass % to 0.6 mass % and from 0.001 mass % to 0.1 mass %, respectively. When Cs and Al are used in combination, their contents may be adjusted to fall within the above-described respective ranges.

Among the elements described above, P forms a chemical bond with the surface of the iron-based soft magnetic powder via oxygen. Accordingly, when the content of P is less than 0.005 mass %, the amount of the chemical bond between the surface of the iron-based soft magnetic powder and the phosphate conversion coating film becomes insufficient, thereby possibly failing to form a strong film. On the other hand, when the content of P exceeds 1 mass %, P not engaged in chemical bonding remains unreacted, thereby possibly rather deteriorating the bonding strength.

When the heat treatment step 2 is performed, Co, Na, S, Cs, and Al have a function of hindering Fe and oxygen from forming a semiconductor, thereby suppressing a reduction in the specific resistance. The effect of Co, Na, and S is optimized by composite addition of them. With regards to Cs and Al, on the other hand, either one may be added. The lower limit of each of the elements is a minimum amount for producing the effect of the composite addition of Co, Na, and S. Further, when Co, Na, S, Cs, and Al are added in an amount exceeding the necessary amount, it is considered that not only a relative balance cannot be maintained upon composite addition but also formation of the chemical bond between P and the surface of the iron-based soft magnetic powder via oxygen may be hindered.

The phosphate conversion coating film may contain Mg or B. With regards to the content of such an element, the contents of Mg and B are preferably from 0.001 mass % to 0.5 mass %, respectively, based on 100 mass % of the iron powder for powder compact.

The thickness of the phosphate conversion coating film is preferably from about 1 nm to 250 nm. When the thickness is less than 1 nm, the insulation effect may sometimes not be developed. When it exceeds 250 nm, on the other hand, the insulation effect is saturated and it is undesirable also from the standpoint of increasing the density of the powder compact. More preferred thickness is from 10 nm to 50 nm.

[Method of Forming a Phosphate Conversion Coating Film]

The iron powder for powder compact to be used in the invention may be prepared in any mode. For example, it can be obtained by mixing a solution obtained by dissolving a P-containing compound in a solvent composed of, for example, water and/or an organic solvent with an iron-based soft magnetic powder, and then evaporating the solvent from the resulting mixture as needed.

Examples of the solvent used in this step include water, hydrophilic organic solvents such as alcohol and ketone, and mixtures thereof. A known surfactant may be added to the solvent.

Examples of the P-containing compound include orthophosphoric acid ($H_3PO_4$). Further, examples of a compound usable for forming the phosphate conversion coating film having the composition as described above include $CO_3(PO_4)_2$ (a source of Co and P), $CO_3(PO_4)_2.8H_2O$ (a source of Co and P), $Na_2HPO_4$ (a source of P and Na), $NaH_2PO_4$ (a source of P and Na), NaH2PO$_4$.nH2O (a source of P and Na), $Al(H_2PO_4)_3$ (a source of P and Al), $Cs_2SO_4$ (a source of Cs and S), $H_2SO_4$ (a source of S), MgO (a source of Mg), and $H_3BO_3$ (a source of B). Among them, use of dihydrogen sodium phosphate ($NaH_2PO_4$) as a source of P and Na makes it possible to obtain a dust core well-balanced in density, strength, and specific resistance.

The addition amount of the P-containing compound relative to the iron-based soft magnetic powder may be any amount insofar as it can provide a phosphate conversion coating film having a composition within the above-described range. For example, the composition of the phosphate conversion coating film can be adjusted within the above-described range by adding from about 1 to 10 parts by mass, based on 100 parts by mass of the iron-based soft magnetic powder, of a solution containing the P-containing compound or a compound further containing elements to be incorporated in the film as needed, which solution has been adjusted to give its solid content of from about 0.01 mass % to 10 mass %, and mixing the resulting mixture by using a known mixing machine such as a mixer, a ball mill, a kneader, a V-shaped blender, or a granulator.

Further, if necessary, the mixture thus obtained may be dried at from 150° C. to 250° C. in the air under reduced pressure or in vacuum after the mixing step. After drying, the dried mixture may be passed through a sieve with an opening of from about 200 μm to 500 μm. After these steps, an iron powder for powder compact having a phosphate conversion coating film formed therein can be obtained.

[Silicone Resin Film]

The iron powder for powder compact according to the invention may have, on the phosphate conversion coating film, a silicone resin film further. Powders bond strongly to each other upon completion of the crosslinking/curing reaction of the silicone resin (upon powder compaction). Further, it forms Si—O bonds excellent in heat resistance and improves the thermal stability of an insulating film.

As the silicone resin, that having more trifunctional T units ($RSiX_3$: X is a hydrolysable group) than bifunctional D units ($R_2SiX_2$: X has the same meanings as described above) is preferred, because a silicone resin having a slow curing rate makes the powder sticky and deteriorates the handling property after formation of the film. A silicone resin containing many tetrafunctional Q units ($SiX_4$: X has the same meanings as described above) is however not preferred, because if so, powders are strongly bonded to each other upon preliminary curing, which makes a subsequent molding step impossible. Accordingly, a silicone resin containing 60 mol % or more of the T unit (more preferably, 80 mol % or more, most preferably 100 mol %) is preferred.

In addition, as the silicone resin, a methyl phenyl silicone resin having a methyl group or a phenyl group as the above-described R is typical. It is considered that a methyl phenyl silicone resin having more phenyl groups has higher heat resistance. Under high-temperature heat treatment conditions as employed in the invention, presence of a phenyl group cannot be said so effective. It is considered that the bulkiness of the phenyl group disturbs the dense glassy network structure to rather deteriorate the thermal stability or the effect of hindering the formation of a compound with iron. Accordingly, it is preferred to use a methyl phenyl silicone resin (for example, "KR255", "KR311", or the like; trade name; product of Shin-Etsu Chemical) having 50 mol % or more of methyl groups, more preferred to use a methyl phenyl silicone resin (for example, "KR300" or the like; trade name; product of Shin-Etsu Chemical) having 70 mol % or more of methyl groups, most preferred to use a methyl silicone resin (for example, "KR251", "KR400", "KR220L", "KR242A", "KR240", "KR500", "KC89", or the like; trade name; product of Shin-Etsu Chemical, "SR24000", or the like; trade name; product of Dow Corning Toray) having no phenyl group. The ratio of a methyl group to a phenyl group and the functionality of the silicone resin (film) can be analyzed using FT-IR, etc.

The deposition amount of the silicone resin film is preferably adjusted to from 0.05 mass % to 0.3 mass % based on 100 mass % of the iron powder for powder compact in which the phosphate conversion coating film and the silicon resin film have been formed in order of mention. When the deposition amount of the silicone resin film is less than 0.05 mass %, the resulting iron powder for powder compact is inferior in insulation and has a low electrical resistance. When the deposition amount of the silicone resin film exceeds 0.3 mass %, on the other hand, it is difficult to obtain a powder compact having an increased density.

The thickness of the silicone resin film is preferably from 1 nm to 200 nm, more preferably, from 20 nm to 150 nm. Further, the total thickness for the phosphate conversion coating film and the silicone resin film is preferably 250 nm or less. When it exceeds 250 nm, the magnetic flux density sometimes decreases greatly.

[Method of Forming Silicone Resin Film]

A silicone resin film is formed, for example, by mixing a silicone resin solution obtained by dissolving a silicone resin in an alcohol or a petroleum-based organic solvent such as toluene or xylene with an iron-based soft magnetic powder having a phosphate conversion coating film (which powder may hereinafter be called "phosphoric acid-based film-having iron powder" simply for the sake of convenience) and then evaporating the organic solvent from the resulting mixture as needed.

The silicone resin may be added to the phosphoric acid-based film-having iron powder in any amount insofar as the deposition amount of the silicone resin film to be formed falls within the above-described range. For example, a resin solution prepared to give its solid content of roughly from 2 mass % to 10 mass % may be added in an amount of from about 0.5 to 10 parts by mass, based on 100 parts by mass of the phosphoric acid-based film-having iron powder, followed by mixing and drying. When the addition amount of the resin solution is less than 0.5 part by mass, it may take much time for mixing or the film thus formed may possibly be non-uniform. When the amount of the resin solution exceeds 10 parts by mass, on the other hand, it may take much time for drying or drying of the mixture may possibly be insufficient. The resin solution may be properly heated in advance. For mixing, a mixing machine similar to those described above can be employed.

In the drying step, it is preferred to evaporate and release the organic solvent sufficiently by heating the mixture at a temperature at which the organic solvent used is evaporated and at the same time to a temperature less than the curing temperature of the silicone resin. A specific drying temperature is preferably from about 60° C. to 80° C. when the alcohol or petroleum-based organic solvent described above is used. After the drying, the dried mixture is preferably passed through a sieve with an opening of from about 300 μm to 500 μm for removing aggregated undissolved lumps.

After drying, it is recommended to heat the iron powder for powder compact having the silicone resin film formed therein (which powder may hereinafter be called "silicone resin film-having iron powder" simply for the sake of convenience), thereby preliminarily curing the silicone resin film. The term "preliminary curing" means a treatment conducted to complete the softening process in a powdery state during curing of the silicone resin film. This preliminary curing treatment can ensure the flowability of the silicone resin film-having iron powder during warm compaction (at from about 100° C. to 250° C.). As a specific method, a method of heating the silicone resin film-having iron powder at near the curing temperature of the silicone resin for a short time is convenient, but a method of using a chemical (curing agent) may also be utilized. A difference between the preliminary curing and curing (not preliminary but complete curing) treatment is that powders are not completely adhered and solidified to each other but easily pulverized after the preliminary curing treatment, whereas the resin is cured and the powders are adhered and solidified to each other after the curing treatment under high-temperature heating which is conducted after compaction of the powder. The powder compact has an improved strength by the complete curing treatment.

As described above, by preliminarily curing the silicone resin and then pulverizing it, powders having excellent flowability can be obtained and they can be charged in a molding die smoothly like sand upon compaction. Without preliminary curing, for example, powders adhere to each other during warm compaction, which sometimes makes it difficult to charge the powders into the molding die in a short time. In practical operation, improvement in the handling property is extremely useful. Further, it has been found that when the preliminary curing is conducted, the dust core thus obtained has markedly improved specific resistance. Although the reason has not been elucidated, it is considered that the preliminary curing improves adhesion between iron powders for powder compact.

When the preliminary curing is performed using a short time heating method, the heat treatment may be performed preferably at from 100° C. to 200° C. for from 5 to 100 minutes, more preferably at from 130° C. to 170° C. for from 10 to 30 minutes. Also after the preliminary curing, the powders are preferably passed through a sieve as described above.

[Lubricant]

The iron powder for powder compact according to the invention further contains a lubricant. Due to the action of this lubricant, frictional resistance between the iron powders for powder compact or between the iron powder and the inner wall of a molding die can be reduced upon compaction of the iron powder and thereby die galling of the powder compact or heat generation during compaction can be prevented. In order to produce such an effect effectively, the lubricant is contained in an amount of preferably 0.2 mass % or more based on the whole amount of the mixture of the iron powder for powder compact and the lubricant. An increase in the amount of the lubricant is not effective for increasing the density of the powder compact so that the amount is kept to preferably 0.8 mass % or less. When the lubricant is applied onto the inner wall surface of the molding die and then compaction is performed (die-wall lubrication compaction), the amount of the lubricant may be less than 0.2 mass %.

As the lubricant, those conventionally known may be used. Specific examples include powders of a metal salt of stearic acid such as zinc stearate, lithium stearate, and calcium stearate, polyhydroxycarboxylic acid amides, fatty acid amides such as ethylenebisstearylamide and (N-octadecenyl)hexadecanoic acid amide, paraffin, wax, and natural or synthesis resin derivatives. Among them, polyhydroxycarboxylic acid amides and fatty acid amides are preferred. These lubricants may be used either singly or in combination.

Examples of the polyhydroxycarboxylic acid amide include those represented by the following formula: $C_mH_{m+1}(OH)_m$—CONH—$C_nH_{2n+1}$ (wherein, m stands for 2 or 5 and n stands for an integer from 6 to 24) described in WO 2005/068588.

More specific examples include the following polyhydroxycarboxylic acid amides:

(1) n-$C_2H_3(OH)_2$—CONH-n-$C_6H_{13}$ (N-hexyl)glyceric acid amide (2) n-$C_2H_3(OH)_2$—CONH-n-$C_8H_{17}$ (N-octyl)glyceric acid amide (3) n-$C_2H_3(OH)_2$—CONH-n-$C_{18}H_{37}$ (N-octadecyl)glyceric acid amide (4) n-$C_2H_3(OH)_2$—CONH-n-$C_8H_{35}$ (N-octadecenyl)glyceric acid amide (5) n-$C_2H_3(OH)_2$—CONH-n-$C_{22}H_{45}$ (N-docosyl)glyceric acid amide (6) n-$C_2H_3(OH)_2$—CONH-n-$C_{24}H_{49}$ (N-tetracosyl)glyceric acid amide (7) n-$C_5H_6(OH)_5$—CONH-n-$C_6H_{13}$ (N-hexyl)gluconic acid amide (8) n-$C_5H_6(OH)_5$—CONH-n-$C_{18}H_{17}$ (N-octyl)gluconic acid amide (9) n-$C_5H_6(OH)_5$—CONH-n-$C_{18}H_{37}$ (N-octadecyl)gluconic acid amide

(10) n-$C_5H_6(OH)_5$—CONH-n-$C_{18}H_{35}$ (N-octadecenyl)gluconic acid amide

(11) n-$C_5H_6(OH)_5$—CONH-n-$C_{22}H_{45}$ (N-docosyl)gluconic acid amide

(12) n-$C_5H_6(OH)_5$—CONH-n-$C_{24}H_{49}$ (N-tetracosyl)gluconic acid amide (Compaction)

The powder compact can be obtained by compaction of the above-described iron powder for powder compact. No particular limitation is imposed on the compaction process and a conventionally known process can be employed.

The compaction is performed preferably at a surface pressure from 490 MPa to 1960 MPa, more preferably, from 790 MPa to 1180 MPa. Compaction at a pressure of 980 MPa or more is particularly preferred because a dust core having a final density of 7.55 g/cm$^3$ or more can be obtained easily and moreover, a dust core having a high strength and good magnetic properties (flux density) can be obtained. The compaction can be performed as either room temperature compaction or warm compaction (at from 100 to 250° C.). Warm die wall lubrication molding is more preferred because a dust core having a higher strength can be obtained by it. As a measure of the strength of the dust core, a bending strength, as measured by the measuring method described later in Examples, is employed and the dust core has a bending strength of preferably 100 MPa or more, more preferably 120 MPa or more.

[Heat Treatment Step 1]

The production process according to the invention includes a step of heating a powder compact, which has been obtained by compaction, at a temperature of 550° C. or more but not more than 650° C. in an inert atmosphere (heat treatment step 1). This step can thermally decompose the lubricant to remove it or relieve the strain from the powder compact.

Specific examples of the heat treatment step 1 include a method of charging a powder compact in a pressure vessel, sealing an inert gas in the vessel to saturate the vessel with the inert gas, and heating the internal temperature of the vessel to within the above-described temperature range.

By performing the heat treatment step 1 in an inert gas atmosphere, it is possible to prevent the surface of the iron powder for powder compact from being oxidized during the step 1. Examples of the inert gas include nitrogen, noble gases such as helium and argon, and vacuum. Among them, nitrogen and also vacuum capable of efficiently removing the decomposed lubricant are preferred. The inert atmosphere may contain a gas other than the inert gas within a range not to impair the object of the heat treatment step 1.

The lubricant can be thermally decomposed and removed by carrying out the heat treatment step 1. When the heat treatment step 1 is performed within the above-described temperature range (550° C. or more but not more than 650° C.), the strain can be relieved from the powder compact while preventing breakage of the phosphate conversion coating film (insulating film). When the heat treatment step 1 is performed at a temperature lower than 550° C., the strain remains (insufficient relief of the strain) and an increase in hysteresis loss due to compaction cannot sometimes be reduced sufficiently. When the heat treatment step 1 is performed at a temperature higher than 650° C., due to a thinning tendency of the phosphate conversion coating film (insulating film) on the surface of the ion powder by heating, the iron phosphate film (insulating film) may be broken and an eddy current loss (corresponding to coercivity) may increase, resulting in an increase in iron loss of the dust core thus obtained. The heating temperature of the heat treatment step 1 is preferably 580° C. or more (more preferably 590° C. or more) but not more than 640° C. (more preferably not more than 630° C.).

The heating time is preferably 20 minutes or more (more preferably 25 minutes or more). The effect available by the heat treatment step 1 cannot always be produced sufficiently when the heating time is short. The longer heating time is preferred from the standpoint of relieving the strain. High temperature heat treatment for long hours causes thinning of the phosphate conversion coating film as described above and deteriorates insulation properties so that the heating time is preferably, for example, 180 minutes or less (more preferably 60 minutes or less, still more preferably 35 minutes or less).

[Heat Treatment Step 2]

The production process according to the invention includes, subsequent to the heat treatment step 1, a step of heating at a temperature of 420° C. or more but not more than 530° C. in an oxidizing atmosphere (heat treatment step 2). In this step, the surface of the iron powder for powder compact is oxidized, which reinforces the bond between the surface of the iron powder for powder compact and the phosphate conversion coating film and also the bond between the phosphate conversion coating films, making it possible to provide a dust core having an improved mechanical strength.

Specific examples of the heat treatment step 2 include a method of cooling the powder compact after completion of the heat treatment step 1, purging the pressure vessel with an oxidizing gas to saturate the container with the oxidizing gas, and heating or keeping the inside of the vessel to or within the above-described temperature range.

As the oxidizing gas, at least one selected from the air, oxygen, ozone and water vapor can be used. Among them, the air is preferred from the standpoint of production cost.

When the heat treatment step 2 is performed within the above-described temperature range (420° C. or more but not more than 530° C.), it is possible to sufficiently oxidize the surface of the iron powder for powder compact while preventing the phosphate conversion coating film (insulating film) from being broken. When the heat treatment step 2 is performed at a temperature less than 420° C., it may take long hours for allowing the oxidation to reach inside the powder compact. When the heat treatment step 2 is performed at a temperature more than 530° C., the interface strength between the iron powder for powder compact and the insu lating film (phosphate conversion coating film) may decrease and a dust core thus obtained may have a reduced mechanical strength. In addition, due to the progress of oxidation on the surface of the powder compact in a short time, it is sometimes impossible to sufficiently oxidize even the space between the iron powders (inside the powder compact). The heating temperature of the heat treatment step 2 is preferably as low as from 420° C. to 450° C. When the heat treatment step 2 is conducted at low temperature, the oxidizing rate on the surface of the iron powder can be adjusted properly, making it possible to sufficiently oxidize even the inside of the powder compact.

The heating time is preferably 10 minutes or more (more preferably 25 minutes or more). When the heating time is short, the above-described effect of the heat treatment step 2 is not sometimes produced sufficiently. The longer heating time is preferred from the standpoint of sufficiently oxidizing the powder compact. High temperature heat treatment for long hours however thins the phosphate conversion coating film as described above and deteriorates the insulation properties so that the heating time is preferably 180 minutes or less (more preferably 60 minutes or less, still more preferably 35 minutes or less).

When the heat treatment step 1 and the heat treatment step 2 are performed under the above-described conditions, a dust core having high electrically insulating properties, that is, having high specific resistance can be produced without increasing an eddy current loss (corresponding to coercivity).

[Dust Core]

The dust core of the invention can be obtained by cooling the powder compact, which has been subjected to oxidation treatment, to normal temperature.

EXAMPLE

The present invention will hereinafter be described specifically based on examples. The invention is however not limited by the following examples and all changes that come within the spirit described above and to be described later may be embraced in the technical scope of the invention. Unless otherwise specifically indicated, "part" or "parts" and "%" mean "part by mass" or "parts by mass", and "mass %", respectively.

Example 1

(Compaction Step)

Pure iron powders ("Atomel 300NH", trade name; product of Kobe Steel; average particle size from 80 to 100 μm) were used as a soft magnetic powder and a treatment solution (having a phosphoric acid concentration of 1.5 mass %) obtained by mixing 50 parts of water, 30 parts of $Na_2HPO_4$, 10 parts of $H_3PO_4$, 10 parts of $(NH_2OH)2.H_2SO_4$, and 10 parts of $CO_3(PO_4)_2$ and diluting the resulting mixture 10-fold with water was used as a treatment solution for iron phosphate chemical conversion film.

To 1 kg of the iron powders passed through a sieve having an opening of 300 μm was added 50 ml of the treatment solution obtained above. In a V-shaped mixer, the resulting mixture was mixed for 30 minutes or more, dried at 200° C. for 30 minutes in the air, and passed through a sieve with an opening of 30 μm.

Next, a resin solution having a solid concentration of 4.8% was prepared by dissolving, in toluene, a silicone resin "KR220L" (trade name; product of Shin-Etsu Chemical) having 100 mol % of a methyl group and 100 mol % of a T unit. The resulting resin solution was added and mixed with the iron powders to give a resin solid content of 0.15 mass %, dried by heating at 75° C. for 30 minutes in an oven furnace in the air, and then passed through a sieve with an opening of 300 μm. Then, preliminary curing was performed at 150° C. for 30 minutes.

Then, a mixture prepared so as to contain 70% of $C_5H_6(OH)_5$—CONH—$C_{18}H_{37}$ as a polyhydroxycarboxylic acid amide and 30% of $C_{15}H_{31}$—CONH—$C_{18}H_{35}$ as a fatty acid amide (each, product of Nippon Fine Chemical) was added as a lubricant to the iron powders so that the amount of it becomes 0.2% relative to the iron powders. The iron powders for powder compact were poured in a molding die and compaction was performed at a surface pressure of 980 Mpa and room temperature (25° C.) to obtain a powder compact.

(Heat Treatment Steps 1 and 2)

Next, the heat treatment steps 1 and 2 were performed under the conditions as described in Table 1 to prepare a dust core. A heating rate was set at about 5° C./min.

The density, bending strength, flux density, and iron loss of the dust core obtained after heat treatments were measured and shown in Table 1. The measurement methods of them are as described below.

Examples 2 to 5, Comparative Examples 1 to 9

Dust cores were prepared by subjecting the powder compact obtained in Example 1 to the heat treatments described in Table 1, respectively.

[Density]

The density was determined by calculation based on the measured mass and size of the dust core.

[Bending Strength]

The bending strength was determined by making a three-point bending test. For the measurement, a tensile tester ("AUTOGRAPH AG-5000E", trade name; product of Shimadzu Corporation) was used. The dust core having a bending strength of 120 MPa or more is rated A, that having a bending strength of 100 MPa or more but less than 120 MPa is rated B, and that having a bending strength less than 100 MPa is rated C.

[Flux Density]

After each of the dust cores was provided with a primary winding of 400 turns and a secondary winding of 25 turns, the flux density of it at an excitation magnetic field of 10000 A/m was measured using a "B-H characteristic automatic recorder "BHS-40S" (trade name; product of Riken Electron). The dust core having a flux density of 1.55 Tesla (T) or more is rated A and that having a flux density less than 1.55 Tesla (T) is rated B.

[Iron Loss]

After each of the dust cores was provided with a primary winding of 400 turns and a secondary winding of 25 turns, an iron loss was measured at an excitation flux density of 1.0 T and frequency of 400 Hz by using an automatic magnetic measurement apparatus manufactured by Yokogawa Electric Corporation. The dust core having an iron loss of 38 (Watt/mass (W/kg)) or less is rated A, that having an iron loss exceeding 38 (W/kg) but not more than 42 (W/kg) is rated B, and that having an iron loss exceeding 42 (W/kg) is rated C.

TABLE 1

| | Heat treatment step 1 | | | Heat treatment step 2 | | | Properties of dust core | | | | | | |
|---|---|---|---|---|---|---|---|---|---|---|---|---|---|
| | Temp. (° C.) | Atmosphere | Time (min) | Temp. (° C.) | Atmosphere | Time (min) | Density (g/cm$^3$) | Bending strength (MPa) | Bending strength (rating) | Flux density (T) | Flux density (Rating) | Iron loss (W/kg) | Iron loss (Rating) |
| Example 1 | 620 | Nitrogen | 30 | 520 | Air | 30 | 7.55 | 106 | B | 1.56 | A | 41.3 | B |
| Example 2 | 600 | Nitrogen | 30 | 520 | Air | 10 | 7.55 | 103 | B | 1.55 | A | 37.3 | A |
| Example 3 | 600 | Nitrogen | 30 | 520 | Air | 30 | 7.54 | 110 | B | 1.55 | A | 37.4 | A |
| Example 4 | 550 | Nitrogen | 30 | 520 | Air | 30 | 7.55 | 123 | A | 1.57 | A | 41.2 | B |
| Example 5 | 600 | Nitrogen | 30 | 420 | Air | 30 | 7.54 | 112 | B | 1.56 | A | 37.7 | A |
| Comp. Ex. 1 | 600 | Nitrogen | 30 | — | — | 30 | 7.55 | 50 | C | 1.56 | A | 37.5 | A |
| Comp. Ex. 2 | 500 | Nitrogen | 30 | 520 | Air | 30 | 7.55 | 121 | A | 1.55 | A | 48.4 | C |
| Comp. Ex. 3 | 450 | Nitrogen | 30 | 520 | Air | 30 | 7.55 | 74 | C | 1.56 | A | 48.1 | C |
| Comp. Ex. 4 | 600 | Nitrogen | 30 | 550 | Air | 30 | 7.55 | 70 | C | 1.55 | A | 39.4 | B |
| Comp. Ex. 5 | 600 | Nitrogen | 30 | 600 | Air | 30 | 7.55 | 56 | C | 1.56 | A | 40.6 | B |
| Comp. Ex. 6 | 550 | Nitrogen | 30 | 580 | Air | 30 | 7.54 | 79 | C | 1.55 | A | 39.6 | B |
| Comp. Ex. 7 | 600 | Air | 30 | — | — | 30 | 7.54 | 64 | C | 1.55 | A | 39.4 | B |
| Comp. Ex. 8 | 600 | Air | 30 | 520 | Nitrogen | 30 | 7.55 | 70 | C | 1.55 | A | 40.2 | B |
| Comp. Ex. 9 | 500 | Air | 30 | 600 | Nitrogen | 30 | 7.55 | 67 | C | 1.55 | A | 37.9 | A |

Comparison between Examples 1 to 5 and Comparative Example 1 has revealed that a dust core having an excellent bending strength can be obtained by successively carrying heat treatment of a powder compact in a nitrogen atmosphere and heat treatment in an oxidizing atmosphere.

Comparison between Examples 1 to 5 and Comparative Examples 2 and 3 has revealed that when the heat treatment step 1 is performed at a low treatment temperature (less than 550° C.), the resulting dust core has a great iron loss.

Comparison between Examples 1 to 5 and Comparative Examples 4 to 6 has revealed that when the heat treatment step 2 is performed at a high treatment temperature (exceeding 530° C.), the resulting dust core has a low bending strength.

Comparison between Examples 1 to 5 and Comparative Examples 7 to 8 has revealed that when the heat treatment step 1 is performed also in an oxidizing atmosphere, the dust core thus obtained has a low bending strength.

The production process of a dust core according to the invention can produce a dust core having an excellent mechanical strength. The dust core thus obtained is useful as a rotor for motors or as a core for stators.

What is claimed is:

1. A process for producing a dust core, the process comprising:

compacting a mixture to obtain a powder compact, heating the powder compact at 550° C. or more but not more than 650° C. in an inert atmosphere to obtain a heat-treated powder compact, and heating the heat-treated powder compact at 420° C. or more but not more than 530° C. in an oxidizing atmosphere, wherein the mixture is obtained by a process comprising mixing an iron-based soft magnetic powder with a lubricant, the iron-based soft magnetic powder comprises a phosphate conversion coating film on a surface of the powder, and the iron-based soft magnetic powder is suitable for powder compact.

2. The process of claim 1, wherein the iron-based soft magnetic powder further comprises a silicone resin film on the phosphate conversion coating film.

3. The process of claim 1, wherein the inert atmosphere is a nitrogen atmosphere.

4. The process of claim 1, wherein the oxidizing atmosphere is an air atmosphere.

5. The process of claim 1, wherein the lubricant is a polyhydroxycarboxylic acid amide.

* * * * *